US012778324B2

(12) United States Patent
Watkins, Jr.

(10) Patent No.: US 12,778,324 B2
(45) Date of Patent: Nov. 3, 2026

(54) COMPOSITE BLANKET SYSTEM

(71) Applicant: Brave Mind LLC, Cincinnati, OH (US)

(72) Inventor: Damon Eugene Watkins, Jr., Cincinnati, OH (US)

(73) Assignee: Brave Mind, Cincinnati, OH (US)

( * ) Notice: Subject to any disclaimer, the term of this patent is extended or adjusted under 35 U.S.C. 154(b) by 193 days.

(21) Appl. No.: 18/179,663

(22) Filed: Mar. 7, 2023

(65) Prior Publication Data

US 2024/0298821 A1 Sep. 12, 2024

(51) Int. Cl.
*A47G 9/02* (2006.01)

(52) U.S. Cl.
CPC ..... *A47G 9/0215* (2013.01)

(58) Field of Classification Search
CPC ..... H05B 3/34; A47G 9/0223; A47G 9/0215; A47G 9/0207; A47G 9/023; A47G 9/02; A47G 9/0238; A47G 9/0246; A47G 9/0261; A47G 9/0284; A47G 9/06; A47G 9/062; A47G 9/064; A47G 9/066; A47G 9/068; A47G 9/08; A47G 9/083; A47G 9/086; A47G 2009/0269; A47G 2009/0276

See application file for complete search history.

(56) References Cited

U.S. PATENT DOCUMENTS 3,120,721 A * 2/1964 Bukatman ..... A63H 33/00 5/482
3,325,832 A * 6/1967 Malicki ..... A47G 9/0238 5/495
3,696,450 A * 10/1972 Dupler ..... A47G 9/0207 5/486
3,717,888 A * 2/1973 Phelan ..... A47G 9/086 135/117
4,631,765 A * 12/1986 Casey ..... A47G 9/0207 428/33
5,664,269 A * 9/1997 Broder ..... A47G 9/0207 5/482
D453,607 S * 2/2002 Tracy ..... D2/826
6,615,427 B1 * 9/2003 Hailey ..... D05C 17/00 5/482
6,640,362 B1 * 11/2003 Kimball ..... A47G 9/0223 128/854
6,684,422 B2 * 2/2004 LeFevre ..... A61G 5/10 5/655
6,718,577 B2 * 4/2004 Li ..... A47C 21/022 5/482
6,934,985 B2 * 8/2005 Sanders ..... A47G 9/0207 5/413 R
D643,182 S * 8/2011 Harris ..... D2/719
9,775,387 B2 * 10/2017 Parr ..... A41D 3/00
(Continued)

*Primary Examiner* — Tara Schimpf
(74) *Attorney, Agent, or Firm* — Jeremy A. Briggs

(57) ABSTRACT

A blanket including a top layer of fabric and a bottom layer of fabric is disclosed. The blanket may further include a middle layer of mesh disposed between the top layer and the bottom layer. The top layer and the bottom layer may include a first cut-out pattern to enable a user to breathe through the first cut-out pattern when the user wears the blanket. The first cut-out pattern may be disposed in proximity to a blanket top edge. The top layer and the bottom layer may further include a second cut-out pattern disposed in proximity to a blanket bottom edge. The first cut-out pattern may be different from the second cut-out pattern.

20 Claims, 5 Drawing Sheets

(56) References Cited

U.S. PATENT DOCUMENTS 10,157,557 B1 * 12/2018 Martin ..... G09F 23/00
10,588,436 B2 * 3/2020 Waters ..... A47D 13/06
D945,742 S * 3/2022 Leach ..... D2/719
11,986,117 B1 * 5/2024 Holland ..... A47G 9/066
2006/0130235 A1 * 6/2006 Wilson ..... A47G 9/0207 5/482
2007/0151029 A1 * 7/2007 Bridges ..... A62B 99/00 5/482
2007/0169264 A1 * 7/2007 Spicer ..... A47G 9/0207 5/482
2009/0056017 A1 * 3/2009 Jones ..... A47G 9/02 5/485
2009/0299442 A1 * 12/2009 Vergona ..... A47G 9/0215 607/114
2012/0005830 A1 * 1/2012 Wilkinson ..... A47G 9/1045 5/484
2012/0276802 A1 * 11/2012 Anderman ..... A63H 33/00 29/428
2012/0284915 A1 * 11/2012 Najari Ehsani ..... A47G 9/086 5/413 R
2014/0189952 A1 * 7/2014 Crispino ..... A47G 9/02 112/475.08
2014/0352063 A1 * 12/2014 Mitchell ..... A47G 9/0223 5/494
2015/0104118 A1 * 4/2015 Lee ..... A47G 9/062 383/4
2016/0100700 A1 * 4/2016 Dunwood ..... A47G 9/02 5/496
2016/0157638 A1 * 6/2016 Waters ..... A47D 15/006 5/482
2016/0367051 A1 * 12/2016 Chi-Hsueh ..... A47G 9/086
2017/0231407 A1 * 8/2017 Alletto ..... A47G 9/04 5/498
2017/0295961 A1 * 10/2017 Alletto ..... A47G 9/0207
2018/0027998 A1 * 2/2018 Heiman ..... A47G 9/0223
2018/0192794 A1 * 7/2018 Aramli ..... A47G 9/0215
2018/0249849 A1 * 9/2018 Wilkinson ..... A47G 9/062
2019/0290032 A1 * 9/2019 Hill ..... A47G 9/086
2020/0397078 A1 * 12/2020 Sherts ..... A41D 31/06
2021/0000270 A1 * 1/2021 Ropchan ..... A47G 9/0215
2021/0219751 A1 * 7/2021 Lewis ..... A47G 9/0223
2021/0267390 A1 * 9/2021 Storm ..... A47G 9/0223
2022/0218115 A1 * 7/2022 Blakely ..... A47C 21/048
2022/0369798 A1 * 11/2022 Gabaldon ..... A47G 9/0215
2023/0292939 A1 * 9/2023 Foucha ..... A47G 9/0238 5/486

* cited by examiner

COMPOSITE BLANKET SYSTEM

TECHNICAL FIELD

The present disclosure relates to a blanket, and more specifically to a composite blanket system that allows air passage through the blanket.

BACKGROUND

Blankets provide comfort, warmth, and a sense of security to a user. Sometimes, the user may wear the blanket to cover whole user body (including user head), which may create a layer of separation between the user and outside air. This may cause inconvenience to the user. Further, when the user breathes, the air exhaled by the user may get trapped inside the blanket, which may cause further discomfort to the user. In such a scenario, the user may sweat and may face difficulty in breathing. This may affect user's sleep when the user wears the blanket at nighttime. Lack of a restful night sleep may cause drowsiness to the user during daytime, and may result in additional health issues such as stress, anxiety, weight gain, etc.

In addition, lack of air circulation may cause health problems to the user when the user covers the whole body with the blanket. For example, the user may experience skin issues or breathing problems if the user breathes stale air for a long time duration. Thus, there is a need for a blanket that provides ventilation, while still allowing the user to cover the whole body with the blanket.

It is with respect to these and other considerations that the disclosure made herein is presented.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Overview

Figure 1:
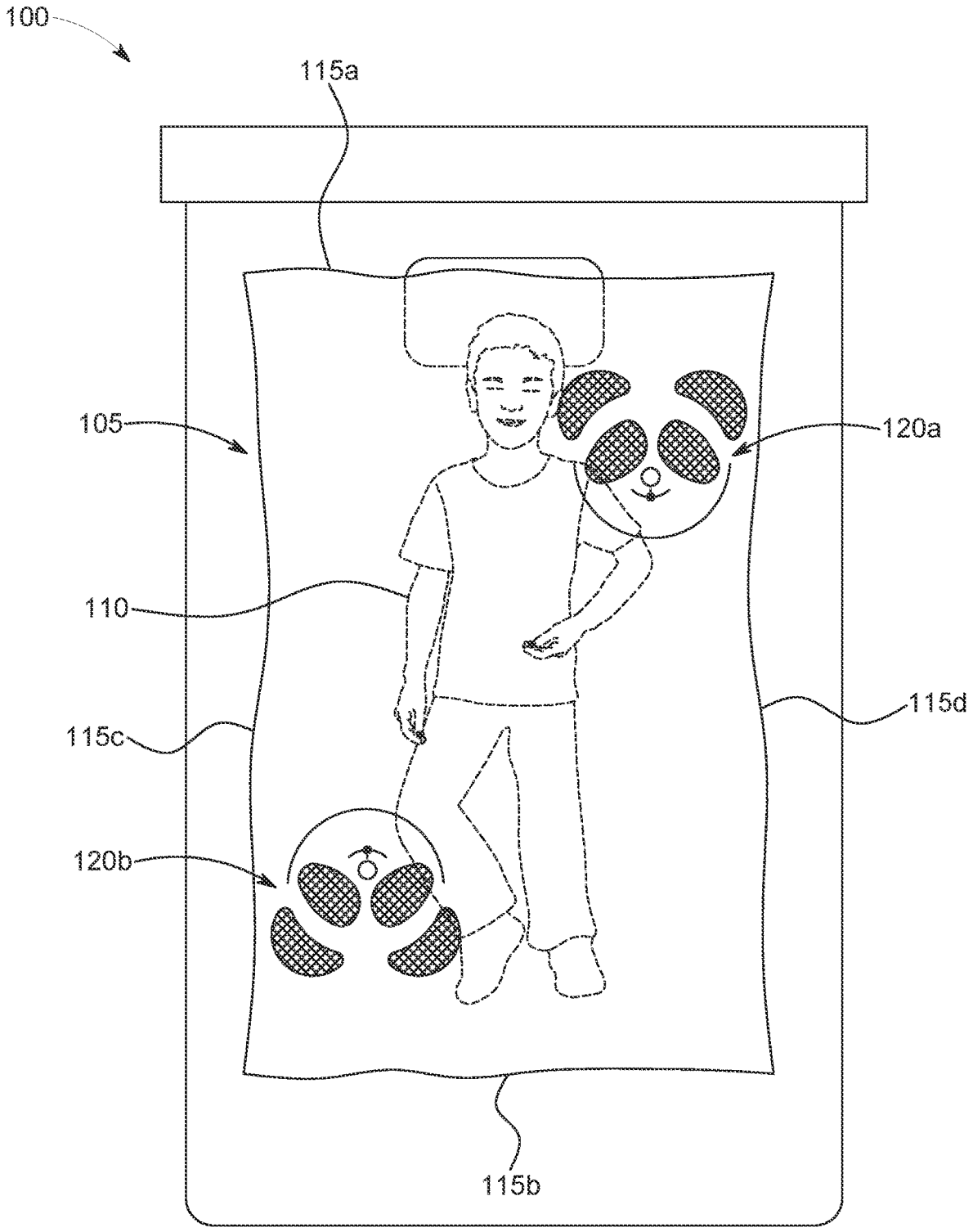
FIG. 1 depicts an example environment in which techniques and structures for providing the systems and methods disclosed herein may be implemented.

The present disclosure is directed towards a composite blanket system ("blanket") that may provide ventilation when a user covers whole user body with the blanket. The blanket may include top and bottom layers that may be made of fabric. The blanket may further include a middle layer that may be disposed between the top layer and the bottom layer. The middle layer may be made of mesh. The blanket may additionally include one or more cut-out patterns that may be disposed on the top layer and the bottom layer, which may enable the user to breathe comfortably (via the mesh) when the user covers user's face with the blanket.

In some aspects, the blanket may include two cut-out patterns (e.g., a first cut-out pattern and a second cut-out pattern). The first cut-out pattern and the second cut-out pattern may be disposed at different blanket surface locations. For example, the first cut-out pattern may be disposed in proximity to a blanket top edge, and the second cut-out pattern may be disposed in proximity to a blanket bottom edge. In some aspects, the first cut-out pattern may be disposed at a blanket top corner position (e.g., a top right corner), and the second cut-out pattern may be disposed at a blanket bottom corner position (e.g., a bottom left corner) to provide proper ventilation to the user when the user wears the blanket. In other aspects, the first cut-out pattern may be disposed at a blanket top center position, and the second cut-out pattern may be disposed at a blanket bottom center position. The first cut-out pattern may further enable the user to see through the middle layer (e.g., via the mesh).

In some aspects, the top layer and the bottom layer may be permanently attached to each other. In other aspects, the top layer and the bottom layer may be removably attached using an attachment mechanism such as hook and loop fasteners, snap buttons, zippers, and/or the like. In an exemplary aspect, edges of the top layer and the bottom layer may be attached using the attachment mechanism.

In further aspects, the blanket may include an internal pocket that may be attached to the top layer or the bottom layer. The internal pocket may enable the user to store small items such as flashlights, small toys, stationery items, etc. The user may access the internal pocket by detaching the top layer and the bottom layer by using the attachment mechanism.

The blanket may further include one or more straps that may be attached to a blanket edge (e.g., a blanket top edge). The straps may enable the user to wear the blanket as a costume (e.g., like a cape). In some aspects, the blanket may include two straps (e.g., a first strap and a second strap). The first strap and the second strap may include a sealing member that may enable the user to removably attach the first strap and the second strap around user's neck to wear the blanket as a cape.

The blanket may further include an integrated push-button body warmer (heating element) that may keep the user body warm. The integrated push-button body warmer may be battery operated. In some aspects, the integrated push-button body warmer may be placed in the internal pocket.

In further aspects, the blanket may include a bendable/flexible wire that may be disposed at blanket periphery/perimeter. The bendable wire may enable the user to mold the blanket in any desired shape. The bendable wire may hold its shape when the user bends the wire, thus enabling the user to mold the blanket into different shapes. For example, the bendable wire may enable the user to make a cave out of the blanket. The user may use the cave for reading, entertainment, etc.

The present disclosure discloses a blanket that may enable the user to wear the blanket comfortably. For example, the cut-out patterns in the blanket may enable the user to breathe conveniently when the user covers whole user body with the blanket. The cut-out patterns may further enable the user to see through, when the user covers user face with the blanket. In addition, the internal pocket may enable the user to store small items inside the blanket, and access the stored items conveniently.

These and other advantages of the present disclosure are provided in detail herein.

Illustrative Embodiments

The disclosure will be described more fully hereinafter with reference to the accompanying drawings, in which example embodiments of the disclosure are shown, and not intended to be limiting.

FIG. 1 depicts an example environment 100 in which techniques and structures for providing the systems and methods disclosed herein may be implemented. The environment 100 may include a composite blanket system 105 (hereinafter referred to as a blanket 105), and a user 110 who may wear the blanket 105. The user 110 may be an infant, a kid, an adult, or an elderly person.

The blanket 105 may be of any size and shape that may vary based on user type and/or physiology. For example, the blanket 105 may be a twin blanket, a single blanket, a queen blanket, a king blanket, and/or the like. Further, the blanket 105 may have any color and/or design. In an exemplary aspect, the blanket 105 may be rectangular, as shown in FIG. 1. In other aspects, the blanket 105 may be of any other shape including, but not limited to square, circle, triangle, and/or the like.

The blanket 105 may include a top edge 115*a*, a bottom edge 115*b*, a left side edge 115*c*, and a right side edge 115*d*. A top edge 115*a* length may be same as or equivalent to a bottom edge 115*b* length. Further, a left side edge 115*c* length may be same as or equivalent to a right side edge 115*d* length. Each edge may be disposed perpendicularly relative to adjacent edges. For example, the top edge 115*a* length and the bottom edge 115*b* length may be in a range of 40-60 inches, and the left side edge 115*c* length and the right-side edge 115*d* length may be in a range of 70-90 inches. The dimensions described here are for illustrative purpose only, and should not be construed as limiting the present disclosure scope.

Figure 2:
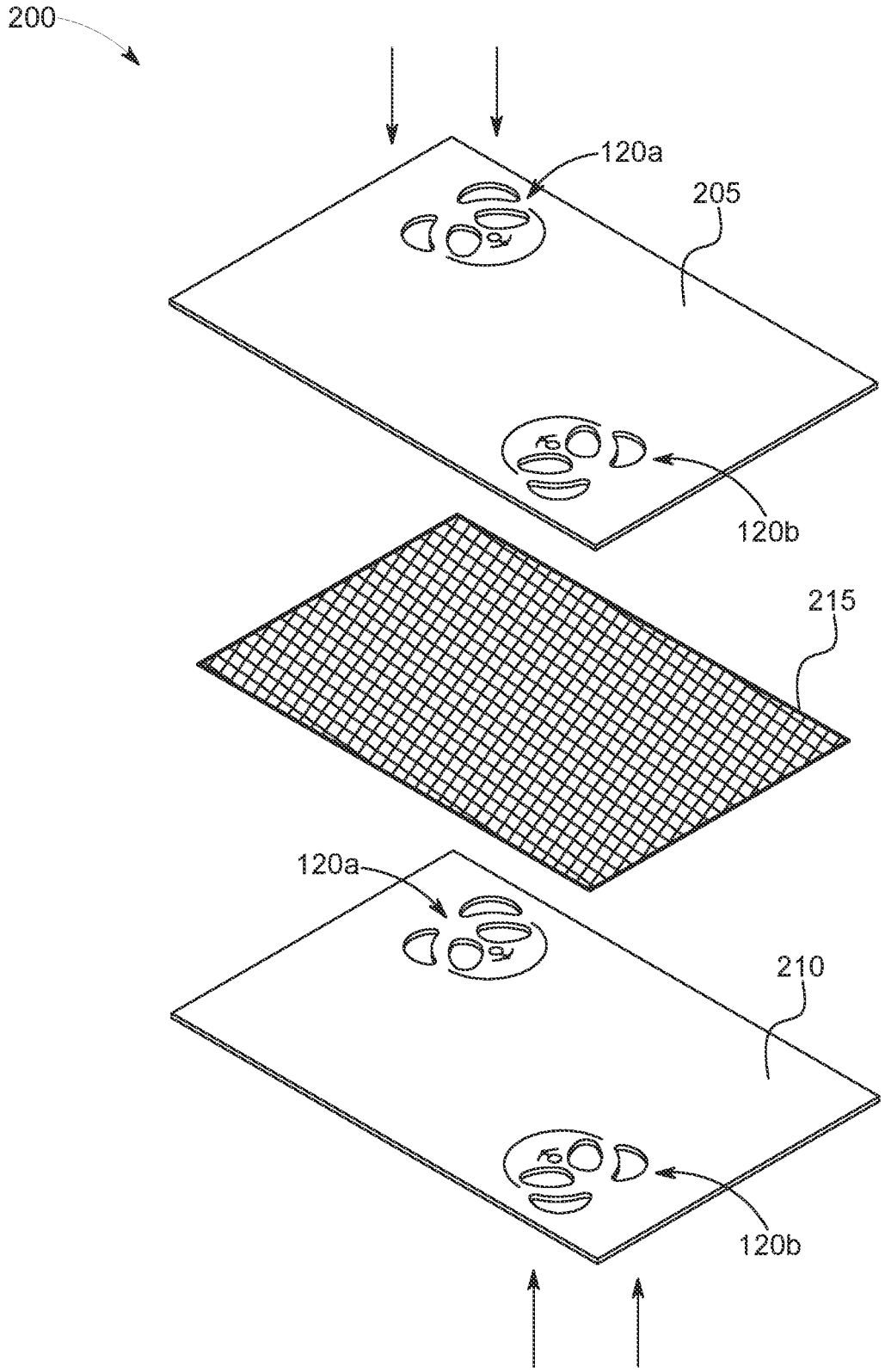
FIG. 2 depicts an example composite blanket system in accordance with the present disclosure.

The blanket 105 may further include one or more cut-out patterns, e.g., a first cut-out pattern 120*a* and a second cut-out pattern 120*b*, disposed on blanket 105 surface (or fabric layers, as described in detail in conjunction with FIG. 2). The cut-out patterns may be of any shape, design and/or size. In some aspects, the first cut-out pattern 120*a* may have same or similar size and design as second cut-out pattern 120*b* size and design. In other aspects, the first cut-out pattern 120*a* may have a different size and/or design from the second cut-out pattern 120*b* size and/or design. In an exemplary aspect (as shown in FIG. 1), the first cut-out pattern 120*a* may be shaped as a face of a panda, and may include holes of different sizes and shapes such as ears, eyes, nose, etc. Similarly, the second cut-out pattern 120*b* may be shaped as the panda face. In other aspects, the first and second cut-out patterns 120*a*, 120*b* may be shaped as a superhero, an animal, a bird, a cartoon character, and/or the like.

In some aspects, the first cut-out pattern 120*a* may be disposed in proximity to the top edge 115*a*, and the second cut-out pattern 120*b* may be disposed in proximity to the bottom edge 115*b*. The first cut-out pattern 120*a* and the second cut-out pattern 120*b* may provide ventilation, and may enable the user 110 to breathe comfortably when the user 110 wears the blanket 105 over whole user body (as shown in FIG. 1).

In some aspects, the first cut-out pattern 120*a* may be disposed at a blanket top right corner (e.g., in proximity to the top edge 115*a* and the right side edge 115*d*). The second cut-out pattern 120*b* may be disposed at a blanket bottom left corner (e.g., in proximity to the bottom edge 115*b* and the left side edge 115*c*). In other aspects, the first cut-out pattern 120*a* and the second cut-out pattern 120*b* may be disposed at other locations within the blanket 105.

The first cut-out pattern 120*a* and the second cut-out pattern 120*b* may be disposed on the blanket 105 such that proper ventilation may be achieved when the user 110 wears the blanket 105 over whole user body. For example, the first cut-out pattern 120*a* may be disposed 4-6 inches from the top edge 115*a*, and 4-6 inches from the right side edge 115*d*. Similarly, the second cut-out pattern 120*b* may be disposed 4-6 inches from the bottom edge 115*b*, and 4-6 inches from the left side edge 115*c*. In an exemplary aspect, the first cut-out pattern 120*a* may be 10-20 inches in length and width, and the second cut-out pattern 120*b* too may be 10-20 inches in length and width. The dimensions may vary based on blanket 105 size.

In further aspects, the first cut-out pattern 120*a* may be disposed at a blanket top center portion, which may enable the user 110 to see through the first cut-out pattern 120*a*. Similarly, the second cut-out pattern 120*b* may be disposed at a blanket bottom center portion.

A person ordinarily skilled in the art may appreciate that the blanket 105 may have only one cut-out pattern (e.g., either the first cut-out pattern 120*a* or the second cut-out pattern 120*b*), or may have more than two cut-out patterns. In addition, the first cut-out pattern 120*a* and the second cut-out pattern 120*b* may include any pattern and may not be limited to the pattern described above. Further, the first cut-out pattern 120*a* and the second cut-out pattern 120*b* may be disposed at any position and may not be limited to the positions described above.

Additional blanket 105 elements are described in detail in conjunction with subsequent figures.

FIG. 2 depicts an example composite blanket system 200 (hereinafter referred to as a blanket 200) in accordance with the present disclosure. The blanket 200 may be same as the blanket 105. The blanket 200 may include a plurality of layers disposed one over the other. For example, the blanket 200 may include a top layer 205, a bottom layer 210, and a middle layer 215 disposed between the top layer 205 and the bottom layer 210.

In some aspects, the top layer 205 and the bottom layer 210 may have same or equivalent dimensions. For example, the top layer 205 and the bottom layer 210 may have same length and width. In an exemplary aspect, a top layer 205 length and a bottom layer 210 length may be in a range of 70-90 inches, and a top layer 205 width and a bottom layer 210 width may be in a range of 40-60 inches.

The top layer 205 and the bottom layer 210 may be made of same or different materials. In a preferred aspect, the top layer 205 and the bottom layer 210 may be made of fabric. For example, the top layer 205 and the bottom layer 210 may be made of cotton, wool, silk, linen, rayon, polyester, and/or the like.

In some aspects, the middle layer 215 may be of equivalent dimensions as the top layer 205 and the bottom layer 210. In other aspects, the middle layer 215 may have different dimensions. For example, length and width of the middle layer 215 may be less than lengths and widths of the top layer 205 and the bottom layer 210. In some aspects, the length and width of the middle layer 215 may correspond to one or more cut-out patterns dimensions discussed in conjunction with FIG. 1. In a preferred embodiment, the middle layer 215 may include mesh. The mesh may be made of any material including, but not limited to, polyester, nylon, spandex, and/or the like. In addition, the mesh may be coarse mesh, normal mesh, or fine mesh.

The top layer 205, the bottom layer 210, and the middle layer 215 may be attached to each other, and may form a unified blanket 200 structure. For example, the top layer 205, the bottom layer 210, and the middle layer 215 may be sewed to each other at the periphery. In some aspects, the top layer 205, the bottom layer 210, and the middle layer 215 may be attached to each other using an adhesive and/or a fastener (e.g., hook and loop fastener).

As discussed in conjunction with FIG. 1, the blanket 200 may include one or more cut-out patterns. The cut-out patterns may include the first cut-out pattern 120*a* and the second cut-out pattern 120*b*. The first cut-out pattern 120*a* and the second cut-out pattern 120*b* may be disposed on both the top layer 205 and the bottom layer 210. Stated another way, the top layer 205 may include the first cut-out pattern 120*a* and the second cut-out pattern 120*b*, and the bottom layer 210 too may include the first cut-out pattern 120*a* and the second cut-out pattern 120*b*. When the three layers (the top layer 205, the bottom layer 210, and the middle layer 215) are attached together, the mesh (middle layer 215) may be hidden between the top layer 205 and the bottom layer 210, and the mesh may only be visible/exposed via the two cut-out patterns (i.e., the first cut-out pattern 120*a* and the second cut-out pattern 120*b*).

Such exposure of the mesh through the first cut-out pattern 120*a* and the second cut-out pattern 120*b* may provide various advantages. For example, the mesh may enable some amount of air to pass through the mesh so that air may be circulated when the user 110 wears the blanket 200 over user's face, while still maintaining blanket warmth (as the mesh may not allow all the outside air to enter the blanket 200). Stated another way, when the user 110 wears the blanket 200 over whole user body, the mesh may allow fresh air (e.g., oxygen) to pass from the top layer 205 towards the bottom layer 210, and vice versa. Similarly, the mesh may allow stale air (e.g., carbon dioxide) to pass from the bottom layer 210 towards the top layer 205, and vice versa. In this manner, the mesh may allow ventilation of air when the user 110 wears the blanket 200 over whole user body.

The first cut-out pattern 120*a* and the second cut-out pattern 120*b* associated with the top layer 205 may be aligned with the first cut-out pattern 120*a* and the second cut-out pattern 120*b* associated with the bottom layer 210, thereby enabling passage of air via the middle layer 215 (via the mesh). For example, the first cut-out pattern 120*a* associated with the top layer 205 may be same as the first cut-out pattern 120*a* associated with the bottom layer 210, and may be disposed on a same position on the top layer 205 and the bottom layer 210. In this manner, air may ventilate easily via the first cut-out pattern 120*a* (and the second cut-out pattern 120*b*) disposed at respective top and bottom layers 205, 210.

The first cut-out pattern 120*a* may be disposed in proximity to a top layer 205 top edge and a bottom layer 210 top edge. Similarly, the second cut-out pattern 120*b* may be disposed in proximity to a top layer 205 bottom edge and a bottom layer 210 bottom edge. In some aspects, the first cut-out pattern 120*a* may be disposed in a top layer 205 corner portion (e.g., top right corner) and a bottom layer 210 corner portion (e.g., top right corner, aligned to the top layer 205 corner portion). Similarly, the second cut-out pattern 120*b* may be disposed in a top layer 205 corner portion (e.g., bottom left corner) and a bottom layer 210 corner portion (e.g., bottom left corner, aligned to the top layer 205 corner position).

In further aspects, the blanket 200 may include more than three layers (the top layer 205, the bottom layer 210, and the middle layer 215). In such scenario, the additional layer(s) may further include the first cut-out pattern 120*a* and the second cut-out pattern 120*b*, disposed at the same "aligned" locations. The additional layer(s) may also include foam, which may make the blanket 200 thick and deformable along a blanket thickness.

Figure 3B:
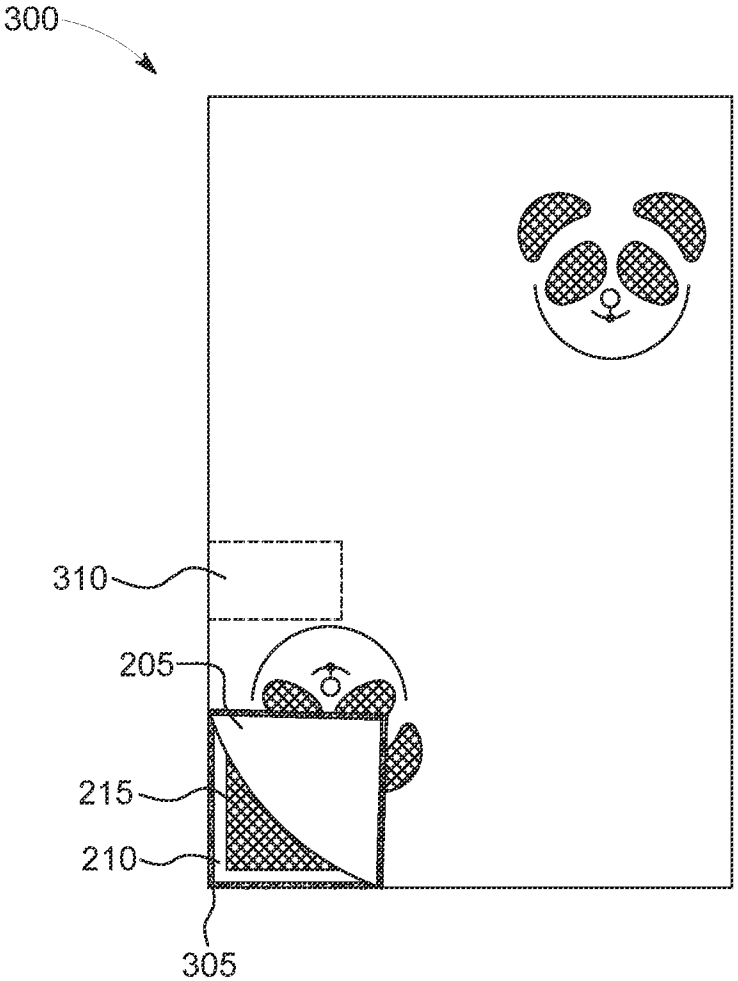
FIG. 3B depicts an example internal pocket in a composite blanket system in accordance with the present disclosure.
Figure 3A:
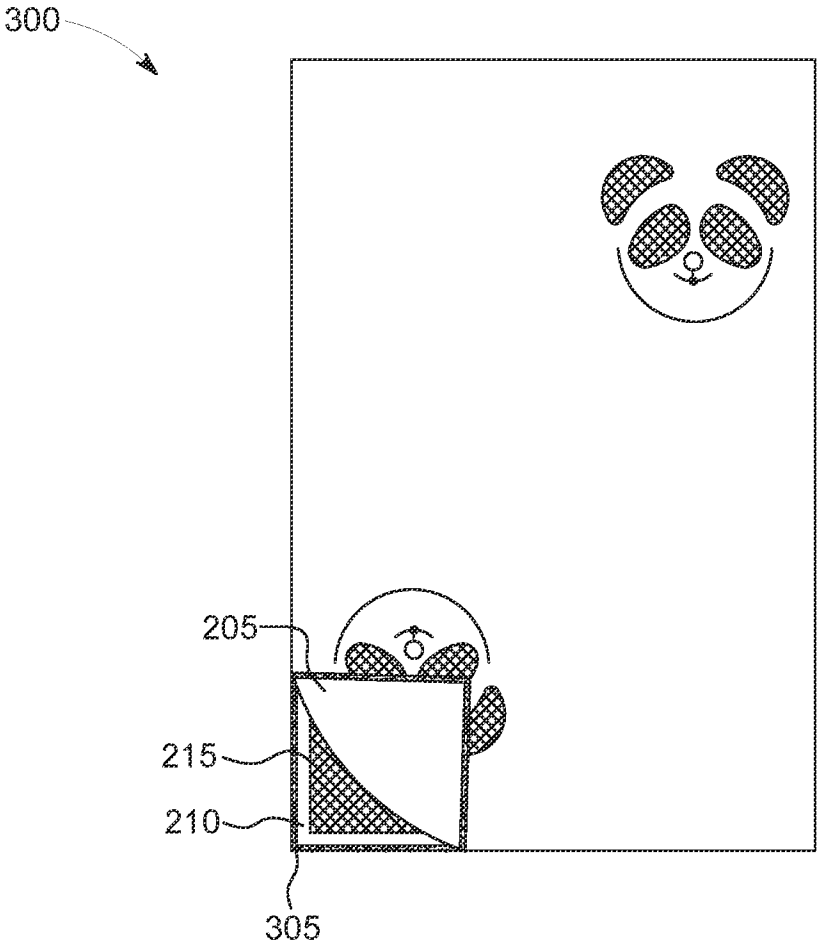
FIG. 3A depicts an example attachment mechanism of a composite blanket system, in accordance with the present disclosure.

FIG. 3A depicts an example attachment mechanism 305 of a composite blanket system 300 (blanket 300), in accordance with the present disclosure. The blanket 300 may be same as the blanket 200 and the blanket 105.

In some aspects, the top layer 205 and the bottom layer 210 may be removably attached to each other via the attachment mechanism 305. In an exemplary aspect, the attachment mechanism 305 may be a hook and loop fastener (or Velcro™). In other aspects, the attachment mechanism 305 may include a zipper, snap buttons, and/or the like. The attachment mechanism 305 may be disposed on a top layer 205 interior/inner surface and a bottom layer 210 interior/inner surface. In some aspects, the attachment mechanism 305 may be disposed along entire lengths of all edges (top, bottom, left, and right edges) of the top layer 205 interior surface and the bottom layer 210 interior surface. In other aspects, the attachment mechanism 305 may be disposed along one or more portions of lengths of all the edges of the top layer 205 interior/inner surface and the bottom layer 210 interior/inner surface.

The attachment mechanism 305 may enable the user 110 to change the top layer 205/bottom layer 210, and to customize the blanket 300. For example, if the top layer 205 and/or the bottom layer 210 get damaged or spoiled, the user 110 may easily replace damaged layer(s) with new layer(s) by using the attachment mechanism 305.

In additional aspects (not shown), the middle layer 215/the mesh too may be attached to the top layer 205 and/or the bottom layer 210 via additional attachment mechanisms, which may be same as the attachment mechanism 305. In this case, the user 110 may replace the middle layer 215, if the middle layer 215 gets damaged. In other aspects, the middle layer 215 may be sewed with the top layer 205 or the bottom layer 210, and the top layer 205 and the bottom layer 210 may be attached to each other via the attachment mechanism 305, as described above.

FIG. 3B depicts an example internal pocket 310 in a composite blanket system (e.g., the blanket 300) in accordance with the present disclosure. In the aspect depicted in FIG. 3B, the top layer 205 and the bottom layer 210 may be partially attached to each other via the attachment mechanism 305, and partially sewed with each other. For example, one or more corners of the top layer 205 and bottom layer 210 may be attached using the attachment mechanism 305, and remaining portions of the top layer 205 and the bottom layer 210 may be attached via another attachment mechanism (e.g., the remaining portions may be sewed to each other).

The internal pocket 310 may be disposed in a blanket 300 interior portion. In some aspects, the internal pocket 310 may be sewed to the top layer 205 interior/inner surface or the bottom layer 210 interior/inner surface. In other aspects, the internal pocket 310 may be removably attached to the top layer 205 interior/inner surface or the bottom layer 210 interior/inner surface. One or more or all edges of the internal pocket 310 may be attached to the top layer 205 interior surface or the bottom layer 210 interior surface.

The internal pocket 310 may be of different shapes, e.g., rectangular, square, oval, circular, etc. In an exemplary aspect depicted in FIG. 3B, the internal pocket 310 may be rectangular. Further, internal pocket 310 length and width may be based on blanket 300 dimensions. Furthermore, the internal pocket 310 may be aligned parallel to a blanket 300 edge (e.g., a left blanket 300 edge), or may be disposed at a predefined angle (e.g., 30 to 60 degrees) relative to the blanket 300 edge.

The internal pocket 310 may be made of fabric (e.g., of same material as the top layer 205 and the bottom layer 210). Alternatively, the internal pocket 310 may be made of mesh (same material as the middle layer 215). Further, the internal pocket 310 may include one or more openings (not shown) that may enable the user 110 to access the internal pocket 310. The one or more openings may be sealable using a sealing mechanism (not shown). The sealing mechanism may include, but is not limited to, a zipper, a hook and loop fastener, a snap button, and/or the like.

The user 110 may use the attachment mechanism 305 to access the internal pocket 310. For example, the user 110 may detach the top layer 205 from the bottom layer 210 by using the attachment mechanism 305, and may access the internal pocket 310. The user 110 may use the internal pocket 310 to store small items such as flashlights, small toys, stationery items, and/or the like. Further, the user 110 may attach the top layer 205 and the bottom layer 210 back by using the attachment mechanism 305, when the user 110 places the small items in the internal pocket 310. In additional aspects, the user 110 may close the openings of the internal pocket 310 before attaching back the top layer 205 and the bottom layer 210. In this manner, the user 110 may secure the small items in the internal pocket 310.

A person ordinarily skilled in the art may appreciate that the attachment mechanism 305 may be located at any other position/pattern, and may not be limited to positions depicted in FIG. 3B. For example, the attachment mechanism 305 may be disposed on a top edge of the top layer 205 and the bottom layer 210, and the internal pocket 310 may be disposed in proximity to the top edge. FIG. 3B and the description above should not be construed as limiting the present disclosure scope.

Figure 4:
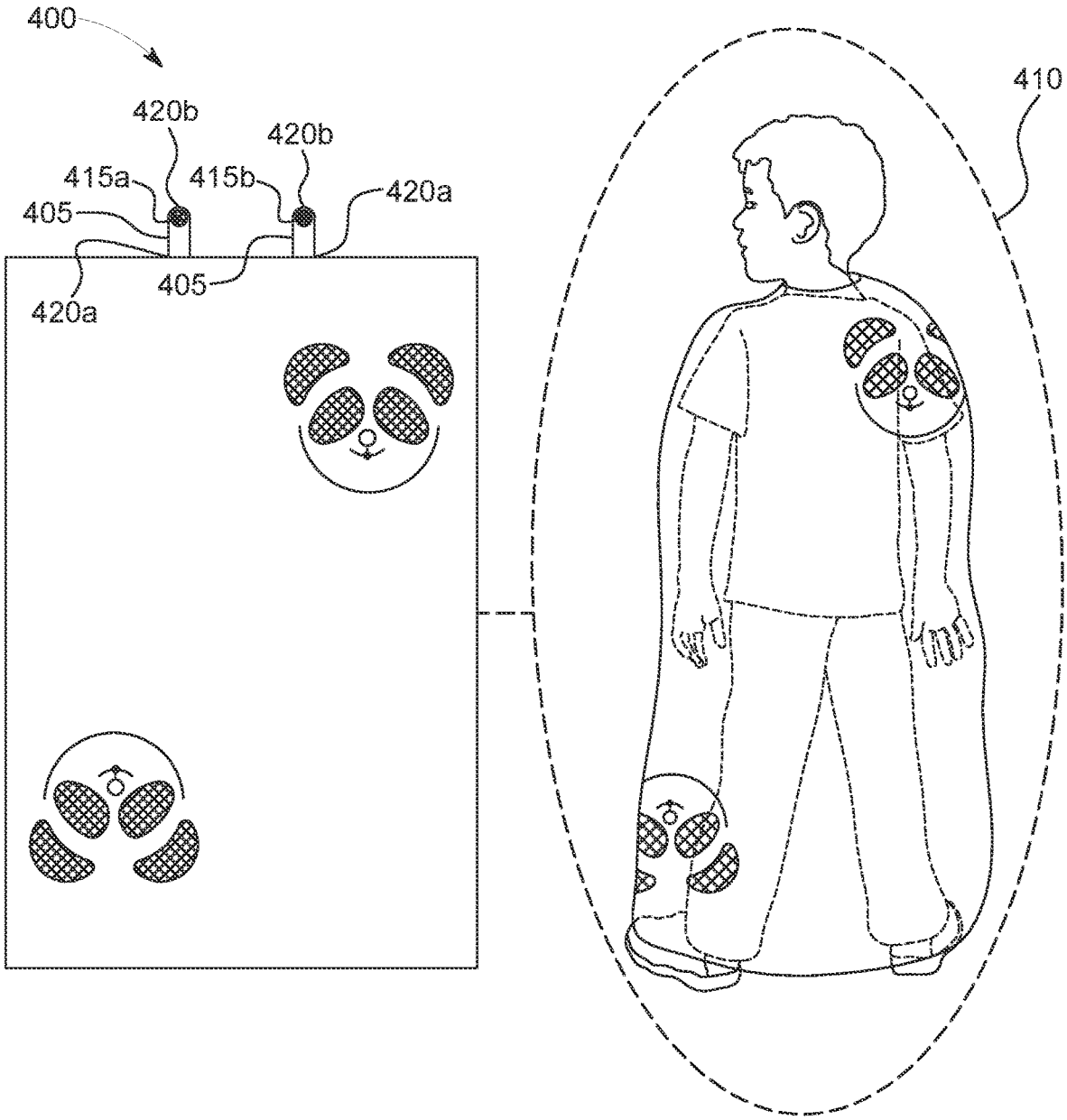
FIG. 4 depicts one or more example straps attached to a composite blanket system in accordance with the present disclosure.

FIG. 4 depicts one or more example straps 405 attached to a composite blanket system 400 (hereinafter referred to as a blanket 400) in accordance with the present disclosure. The blanket 400 may be same as the blanket 105, 200, 300.

The straps 405 may be disposed at a blanket 400 edge. For example, the straps 405 may be disposed at a blanket 400 top edge, as shown in FIG. 4. Specifically, the straps 405 may be disposed in proximity to a center portion of the blanket 400 top edge. The one or more straps 405 may be of any size and/or shape, and made of any material. For example, the straps 405 may be rectangular, 4 to 6 inches long, and may be made of flexible fabric such as nylon, polyester, latex, etc. In some aspects, the blanket 400 may include two straps 405, as shown in FIG. 4.

The straps 405 may enable the user 110 to convert the blanket 400 into a clothing item. For example, the user 110 may attach the straps 405 around user neck (e.g., the straps 405 may enclose the neck) and convert the blanket 400 into a costume, e.g., a cape, as shown in view 410. In this case, the straps 405 may include one or more fasteners 415*a*, 415*b* that may enable the user 110 to attach the straps 405 around the user neck. The fasteners 415*a*, 415*b* may be, for example, hook and loop fasteners, snap buttons, and/or the like.

In some aspects, the straps 405 may be sewed to the top layer 205 or the bottom layer 210. In other aspects, the straps 405 may be removably attached to the top layer 205 or the bottom layer 210. Further, the straps 405 may include a first end 420*a* and a second end 420*b*. The straps 405 may be attached to the blanket 400 top edge via the first end 420*a*, as shown in FIG. 4. In some aspects, the second end 420*b* may include the fasteners 415*a*, 415*b*.

Figure 5B:
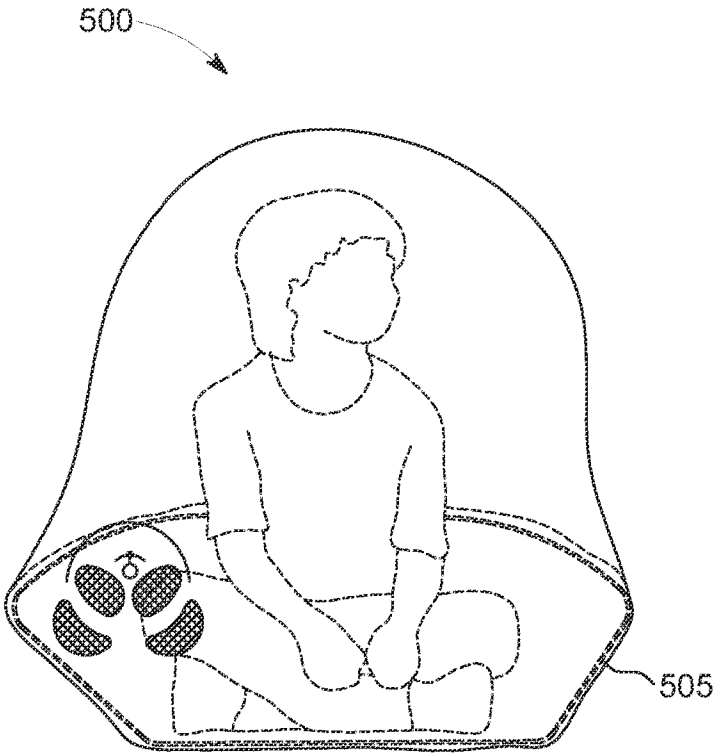
FIGS. 5A and 5B depict an example wiring arrangement in a composite blanket system in accordance with the present disclosure.
Figure 5A:
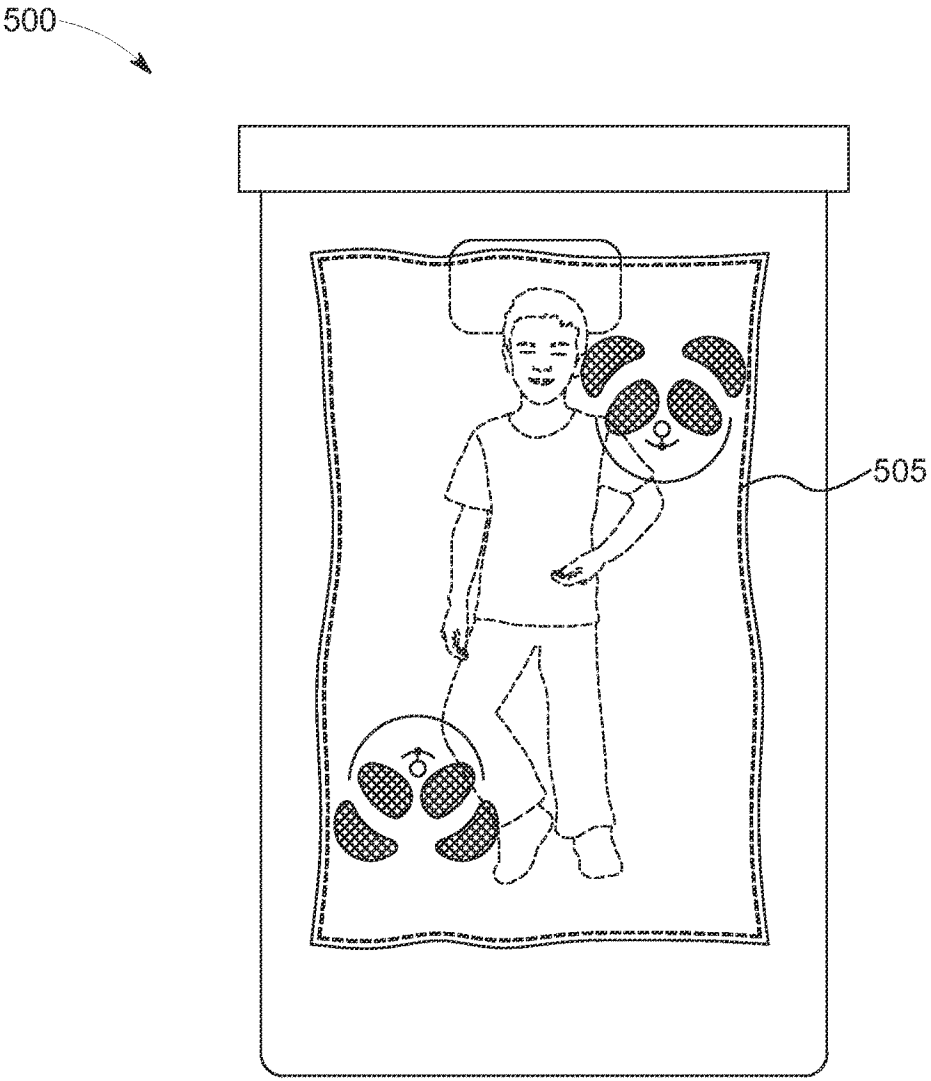

FIGS. 5A and 5B depict an example wiring arrangement 505 in a composite blanket system 500 (hereinafter referred to as a blanket 500) in accordance with the present disclosure. The blanket 500 may be same as the blanket 105, 200, 30, 400.

The wiring arrangement 505 may be disposed at a blanket 500 periphery/perimeter, as shown in FIG. 5A. Specifically, the blanket 500 may include the wiring arrangement 505 in proximity to a blanket 500 top edge, a blanket 500 bottom edge, a blanket 500 left side edge, and a blanket 500 right side edge. The wiring arrangement 505 may include a bendable/flexible wire that may make the blanket 500 moldable and hold blanket's shape when the user 110 "deforms" the wiring arrangement 505. In some aspects, the wire may be made of iron, steel, copper, and/or similar metal.

In an exemplary aspect, the user 110 may "stretch" and straighten the wiring arrangement 505 to use the blanket 500 in the same configuration as described in conjunction with FIG. 1. Specifically, the user 110 may straighten the wiring arrangement 505, and may cover the whole user 110 body by using the blanket 500 as shown in FIG. 5A. In addition, the user 110 may "bend" the wiring arrangement 505 into different configurations to form different blanket 500 shapes. For example, the user 110 may bend the wiring arrangement 505 to form a cave out of the blanket 500, and may use the cave for reading, entertainment, etc., as shown in FIG. 5B.

In additional aspects, the blanket 500 may include an integrated push-button body warmer (e.g., a heating element, not shown) that may keep the user 110 body warm. For example, the integrated push-button body warmer may keep user warm when the user 110 wears the blanket 500. In this case, the integrated push-button body warmer may include a push button, and the user 110 may press the push button to turn on the integrated push-button body warmer. Similarly, the user may 100 may press the push button again to turn-off the integrated push-button body warmer.

The integrated push-button body warmer may be battery operated. In some aspects, the integrated push-button body warmer may be placed in the internal pocket 310 and may be sewed/threaded to the blanket 500, with a small opening to replace batteries.

A person ordinarily skilled in the art may appreciate that by integrating the body warmer with the blanket 500, user's comfort may be enhanced. For example, the user 110 may switch ON the body warmer to augment warmth produced by the blanket 500 in cold weather.

The present disclosure is not be limited to blankets, and may be used in other applications including, but not limited to, clothing (including full face hoodie, other clothes that may cover whole head), accessories (such as caps, face covers), and/or the like.

In the above disclosure, reference has been made to the accompanying drawings, which form a part hereof, which illustrate specific implementations in which the present disclosure may be practiced. It is understood that other implementations may be utilized, and structural changes may be made without departing from the scope of the present disclosure. References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a feature, structure, or characteristic is described in connection with an embodiment, one skilled in the art will recognize such feature, structure, or characteristic in connection with other embodiments whether or not explicitly described.

It should also be understood that the word "example" as used herein is intended to be non-exclusionary and non-limiting in nature. More particularly, the word "example" as used herein indicates one among several examples, and it should be understood that no undue emphasis or preference is being directed to the particular example being described.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating various embodiments and should in no way be construed so as to limit the claims.

Accordingly, it is to be understood that the above description is intended to be illustrative and not restrictive. Many embodiments and applications other than the examples provided would be apparent upon reading the above description. The scope should be determined, not with reference to the above description, but should instead be determined with reference to the appended claims, along with the full scope of equivalents to which such claims are entitled. It is anticipated and intended that future developments will occur in the technologies discussed herein, and that the disclosed systems and methods will be incorporated into such future embodiments. In sum, it should be understood that the application is capable of modification and variation.

All terms used in the claims are intended to be given their ordinary meanings as understood by those knowledgeable in the technologies described herein unless an explicit indication to the contrary is made herein. In particular, use of the singular articles such as "a," "the," "said," etc., should be read to recite one or more of the indicated elements unless a claim recites an explicit limitation to the contrary. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. A blanket comprising:

a top layer of fabric;

a bottom layer of fabric; and a middle layer of mesh disposed between the top layer and the bottom layer, wherein the middle layer extends continuously from top edges of the top layer and the bottom layer to bottom edges of the top layer and the bottom layer, and wherein a length and width of the middle layer is equivalent to lengths and widths of the top layer and the bottom layer, wherein the top layer comprises a first cut-out pattern and the bottom layer comprises a second cut-out pattern to enable a user to breathe through the first cut-out pattern and the second cut-out pattern, wherein the middle layer comprises a continuous middle layer extending across the area of the blanket and is completely enclosed between the top layer and the bottom layer, and wherein the first cut-out pattern is aligned with the second cut-out pattern such that portions of the continuous middle layer are exposed through the first cut-out pattern and the second cut-out pattern while the remaining portions of the middle layer remain enclosed between the top layer and the bottom layer.

2. The blanket of claim 1, wherein the first cut-out pattern and the second cut-out pattern are disposed in proximity to the top edges of the top layer and the bottom layer.

3. The blanket of claim 2, wherein the first cut-out pattern and the second cut-out pattern are disposed at a blanket center top position to enable the user to see through the first cut-out pattern and the second cut-out pattern.

4. The blanket of claim 1, wherein the top layer further comprises a third cut-out pattern and the bottom layer further comprises a fourth cut-out pattern.

5. The blanket of claim 4, wherein the third cut-out pattern and the fourth cut-out pattern are disposed in proximity to the bottom edges of the top layer and the bottom layer.

6. The blanket of claim 4, wherein the first cut-out pattern is different from the third cut-out pattern.

7. The blanket of claim 1 further comprising a strap disposed at a blanket top edge, wherein the strap is configured to be attached around the user's neck.

8. The blanket of claim 1, wherein the top layer is removably attached to the bottom layer using a fastener.

9. The blanket of claim 8, wherein the fastener comprises a hook and loop.

10. The blanket of claim 1 further comprising an internal pocket attached to a top layer inner surface or a bottom layer inner surface.

11. The blanket of claim 1 further comprising a heating element removably attached to the blanket.

12. The blanket of claim 1 further comprising a flexible wire disposed at a blanket perimeter.

13. A blanket comprising:

a top layer of fabric;

a bottom layer of fabric; and a middle layer of mesh disposed between the top layer and the bottom layer, wherein the middle layer extends continuously from top edges of the top layer and the bottom layer to bottom edges of the top layer and the bottom layer, and wherein a length and width of the middle layer is equivalent to lengths and widths of the top layer and the bottom layer, wherein the top layer comprises a first cut-out pattern and the bottom layer comprises a second cut-out pattern, wherein the first cut-out pattern and the second cut-out pattern are disposed in proximity to the top edges of the top layer and the bottom layer, and wherein the top layer further comprises a third cut-out pattern and the bottom layer further comprises a fourth cut-out pattern disposed in proximity to the bottom edges of the top layer and the bottom layer, wherein the middle layer comprises a continuous middle layer extending across the area of the blanket and is completely enclosed between the top layer and the bottom layer, and wherein the first cut-out pattern is aligned with the second cut-out pattern such that portions of the continuous middle layer are exposed through the first cut-out pattern and the second cut-out pattern while the remaining portions of the middle layer remain enclosed between the top layer and the bottom layer.

14. The blanket of claim 13, wherein the first cut-out pattern and the second cut-out pattern are disposed at a blanket center top position to enable a user to see through the first cut-out pattern.

15. The blanket of claim 13, wherein the first cut-out pattern is different from the third cut-out pattern.

16. The blanket of claim 13 further comprising a strap disposed at a blanket top edge, wherein the strap is configured to be attached around a user's neck.

17. The blanket of claim 13, wherein the top layer is removably attached to the bottom layer using a fastener.

18. The blanket of claim 17, wherein the fastener comprises a hook and loop.

19. The blanket of claim 13 further comprising an internal pocket attached to a top layer inner surface or a bottom layer inner surface.

20. A blanket comprising:

a top layer of fabric;

a bottom layer of fabric;

a middle layer of mesh disposed between the top layer and the bottom layer, wherein the middle layer extends continuously from top edges of the top layer and the bottom layer to bottom edges of the top layer and the bottom layer, and wherein a length and width of the middle layer is equivalent to lengths and widths of the top layer and the bottom layer, wherein the top layer comprises a first cut-out pattern and the bottom layer comprises a second cut-out pattern to enable a user to breathe through the first cut-out pattern and the second cut-out pattern, wherein the middle layer comprises a continuous middle layer extending across the area of the blanket and is completely enclosed between the top layer and the bottom layer, wherein the first cut-out pattern is aligned with the second cut-out pattern such that portions of the continuous middle layer are exposed through the first cut-out pattern and the second cut-out pattern while the remaining portions of the middle layer remain enclosed between the top layer and the bottom layer; and a strap disposed at a blanket top edge, wherein the strap is configured to be attached around the user's neck.

* * * * *